United States Patent [19]

Yoshida

[11] Patent Number: 4,490,889

[45] Date of Patent: Jan. 1, 1985

[54] SLIDE FASTENER ASSEMBLY

[75] Inventor: Hiroshi Yoshida, Kurobe, Japan

[73] Assignee: Yoshida Kogyo K.K., Tokyo, Japan

[21] Appl. No.: 363,494

[22] Filed: Mar. 30, 1982

[30] Foreign Application Priority Data

Apr. 9, 1981 [JP] Japan ..... 56-51268

[51] Int. Cl.[3] ..... A44B 19/26

[52] U.S. Cl. ..... 24/427; 24/421

[58] Field of Search ..... 24/205 R, 205 G, 205.1 R, 24/205.11 R, 205.11 F, 205.12, 205.13, 205 BD, 205.14 R, 415–427

[56] References Cited

U.S. PATENT DOCUMENTS 3,591,901 7/1971 Kedzierski ..... 24/205.1 R
3,798,715 3/1974 Moertel ..... 24/205.1 R
3,854,175 12/1974 Yoshida ..... 24/427
3,959,858 6/1976 Fukuroi ..... 24/205.11 R
4,055,876 11/1977 Ackermann et al. ..... 24/205.1 R
4,071,928 2/1978 Oda ..... 24/427

*Primary Examiner*—Gene Mancene
*Assistant Examiner*—James Hakomaki
*Attorney, Agent, or Firm*—Hill, Van Santen, Steadman & Simpson

[57] ABSTRACT

A slide fastener has a top end stop or stops dimensioned to be receivable within the interior of a slider having upper and lower shields connected together by a neck or diamond portion. This portion of the slider is recessed to receive a protuberance of the top end stop so as to reduce the resistance encountered upon starting movement of the slider in a direction to open the fastener.

6 Claims, 8 Drawing Figures

FIG. 1
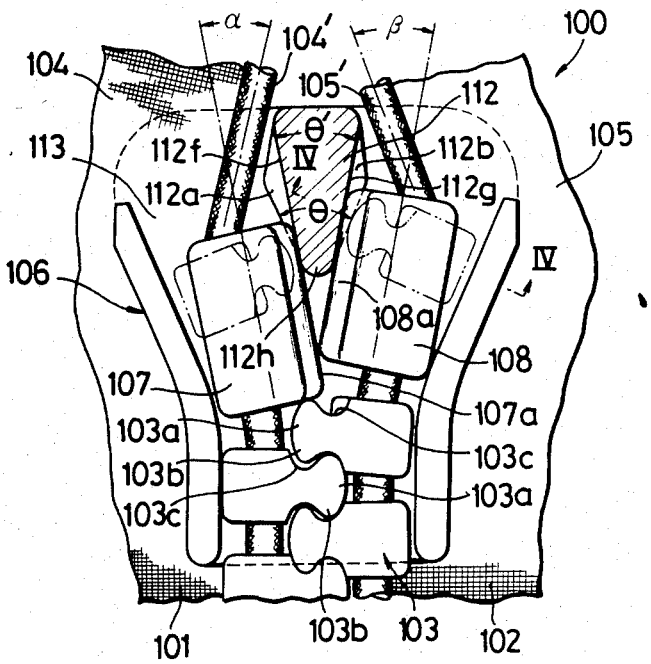
FIG. 2
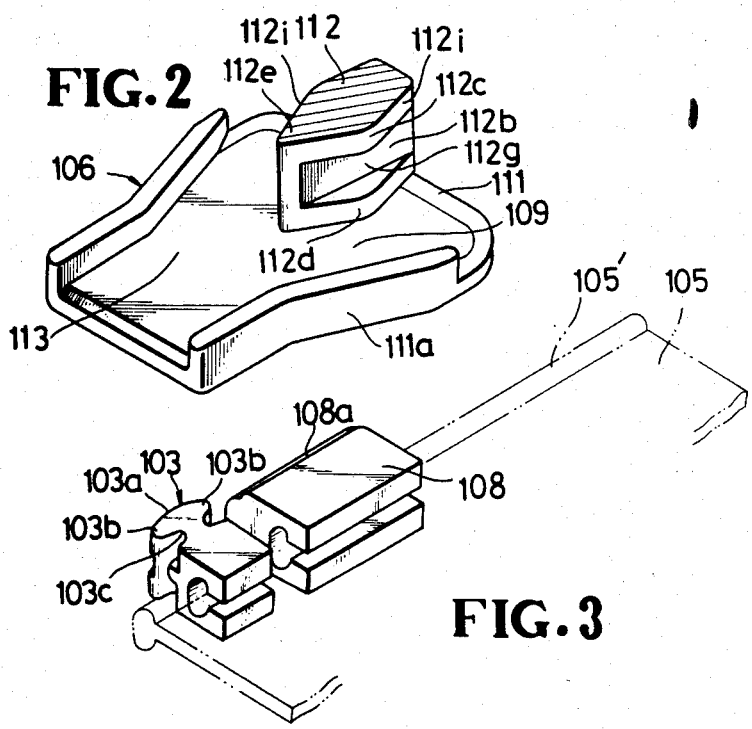
FIG. 3

SLIDE FASTENER ASSEMBLY

BACKGROUND OF THE INVENTION

1. Field of the Invention

This invention relates to slide fasteners and more particularly to a slide fastener assembly to the type in which top end stops are allowed to enter the interior of a slider.

2. Prior Art

Numerous slide fasteners of the type described are known in the art. A typical example of such slide fasteners is illustrated in FIG. 8, wherein the slider fastener is shown in fully closed disposition with both stringer tapes 10,11 brought together at an end of the fastener and attached by a sewn seam M to a garment, not shown. In this disposition, the top end stops 12,13 are trapped and locked between a diamond 14 and respective side flanges of a slider 15. The beaded edges 16,17 of the tapes 10,11 are devoid of fastener elements 18 and extend from the respective end stops 12,13 to the seam M near the upper ends of the tapes 10,11. The edges 16,17 are spread apart to assume an inverted Y-shape. The angle at which the Y-shaped region of the beaded edges 16,17 spreads or flares is determined by and dependent upon an angle $\theta$ of the diamond 14. The diamond angle $\theta$ is also an important factor bearing upon the resistance which is encountered during starting movement of the slider 15 in a direction to open or separate the fastener. The starting resistance is also variable with the coefficient of friction between the diamond 14 and the end stops 12,13, such coefficient of friction being dependent upon the material used for these parts. The starting resistance may further be variable due to the angles $\alpha$ and $\beta$ at which the beaded edges 16 and 17 respectively flex with respect to the longitudinal axis of the end stops 12,13. The slider starting resistance decreases as the the angles $\alpha$ and $\beta$ decrease. However, if these angles were to be reduced without changing the diamond angle $\theta$, this reduction could be done by locating the sewn seam M of the beaded edges 16,17 more remotely from the end stops 12,13. Such a change would however result in fastener stringers being left unclosed at the top end of the fastener.

On the other hand, the diamond angle $\theta$ is required to be about 50 degrees in order to maintain the normal satisfactory operation of opening and closing the fastener (i.e. to disengage and engage the rows of fastener elements 18), and hence cannot be reduced too greatly.

SUMMARY OF THE INVENTION

A slide fastener according to the invention has a pair of stringers, a slider to engage and disengage the stringers, and a top end stop engageable with the slider, the slider having a neck or diamond recessed to receive a complimentary part of the end stop.

An object of the invention is to provide a slide fastener which will eliminate the aforementioned drawbacks of the prior art fasteners.

A more specific object of the invention is to provide a slide fastener of the type herein described incorporating structural features to enable the slider to start movement in a fastener opening direction with a minimum of resistance.

According to the invention, there is provided a slide fastener assembly which comprises a pair of stringers having oppositely disposed rows of fastener elements secured to respective support tapes, a slider having upper and lower shields and a diamond portion connecting said shields in spaced relation to provide a substantially Y-shaped guide channel, said slider being movable to take said rows of fastener elements into and out of engagement, and a top end stop dimensioned to be receivable within the guide channel of said slider and having a protuberance, said diamond having formed in at least one side wall thereof an elongated longitudinal recess for receiving said protuberance of said top end stop, the remaining portions of said side wall being disposed for guiding engagement with said rows of fastener elements.

Other objects and features appear or are pointed out as the description proceeds with reference to the accompanying drawings which illustrate by way of example some preferred embodiments.

BRIEF DESCRIPTION OF THE DRAWINGS

FIG. 1 is a plan view on enlarged scale of a portion of a slide fastener according to the invention, with an upper shield of a slider removed to reveal the relative positions of the fastener parts;

FIG. 2 is a perspective view on smaller scale of the slider of FIG. 1 with its upper shield removed;

FIG. 3 is a perspective view on smaller scale of a portion shown in FIG. 1;

and

Figure 8:
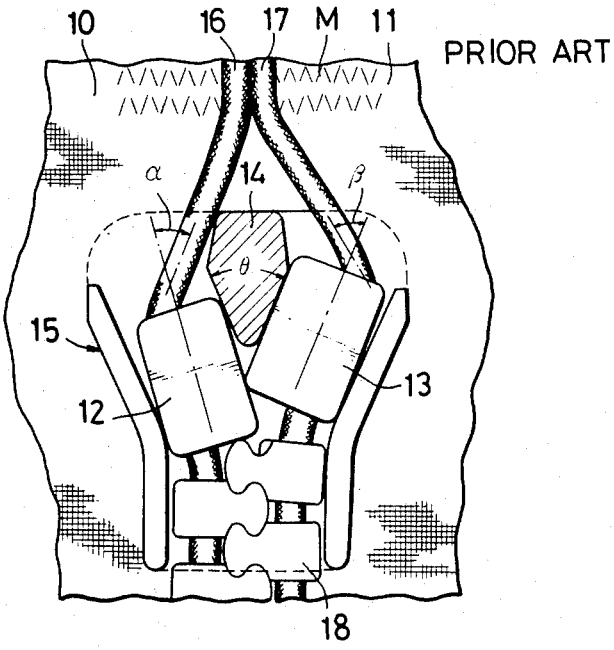

FIG. 8 is a plan view on enlarged scale of a prior art fastener with an upper slider shield removed to show the positional relations of its parts.

DETAILED DESCRIPTION OF THE PREFERRED EMBODIMENTS

FIG. 1 shows an important portion of a slide fastener assembly 100 embodying the invention, which assembly comprises a pair of stringers 101 and 102 having oppositely disposed rows of fastener elements 103 secured to respective support tapes 104 and 105, a slider 106 movable to take the rows of elements 103 into and out of engagement, and a pair of top end stops 107 and 108 each dimensioned to be receivable within the interior of the slider 106. Each of the support tapes 104,105 has a beaded edge 104', (105') extending along one of its longitudinal edges and utilized for mounting thereon the respective row of fastener elements 103 which in the illustrated embodiment is of a discrete formation as contrasted to a continuous formation. Each individual fastener element 103 has a coupling head portion **103*a* with side projections 103*b* and corresponding recesses 103*c*** for receiving the side projections of a complementary fastener element on the other or mating stringer.

The slider 106 comprises a slider body 109 (FIG. 2) having an upper shield 110 (FIG. 4) and a lower shield 111 connected together at their respective front ends and in spaced opposed relation by a neck portion or diamond 112 to provide a substantially Y-shaped guide channel 113 (FIG. 2) for the passage therethrough of the fastener elements 103. The upper and lower shields 110 and 111 have side flanges 110*a* and 111*a*, respectively which serve to retain the fastener elements 103 in the guide channel 113 during movement of the slider 106 along the rows of elements 103 to open or close the slide fastener 100 in a well known manner. The slider 106 is manipulated usually by a pull tab which is omitted from the present illustration as it constitutes no important aspect of the invention.

Figure 4:
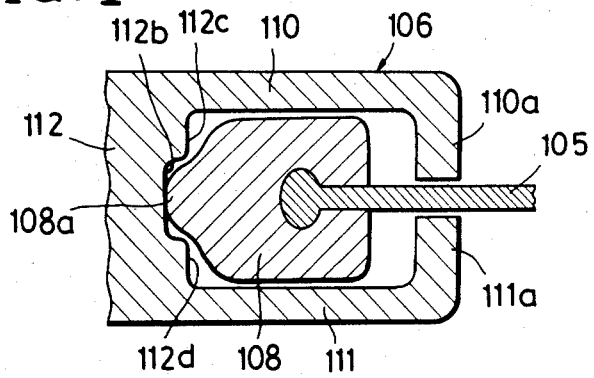
FIG. 4 is a cross-sectional view on enlarged scale taken on the line IV—IV of FIG. 1.
Figure 5:
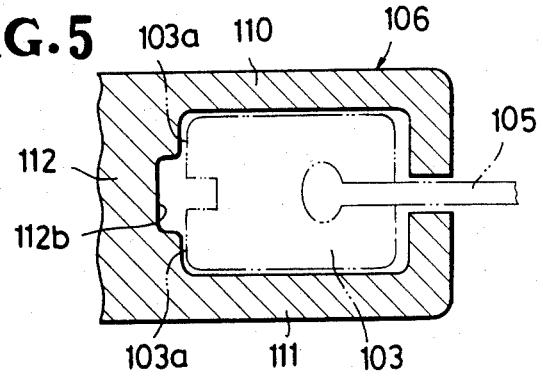
FIG. 5 is a transverse cross-sectional view on enlarged scale of the fastener stringer showing the positional relation between the fastener element and the slider of FIG. 1.

According to an important aspect of the invention, the diamond 112 (FIG. 1) of the slider 106 has a pair of symmetric elongated longitudinal recesses 112*a* and 112*b* formed, respectively, in and extending centrally of opposite side walls 112*i* (FIG. 2) of the diamond 112 for receiving protuberances 107*a* and 108*a* which extend from the inner longitudinal edges of the respective top end stops 107 and 108 as better shown in FIG. 4. The provision of the recesses 112*a* and 112*b* results in the formation of an upper peripheral guide surface 112*c* and a lower peripheral guide surface 112*d* at opposite sides of the diamond 112 converging toward the rear end of the slider 106 to form an un-offset triangular head 112*e* and offset longitudinal side wall portions 112*f* and 112*g* as better shown in FIG. 2. The peripheral guide surfaces 112*c*,112*d* are disposed for guided engagement with the coupling head portions 103*a* of respective rows of fastener elements 103 during operative movement of the slider 106 as better shown in FIG. 5. The un-offset triangular head 112*e* has an angle $\theta$ of about 50 degrees sufficient to effect separation of the rows of fastener elements 103 during movement of the slider 106 in a direction to open the fastener 100.

The offset side wall portions 112*f*,112*g* extend divergently toward the front end of the slider 106 at a relatively small angle, or stated otherwise extend convergently toward the rear end of the slider 106 and form an offset triangular head 112*h* which has an angle $\theta'$ substantially smaller than the angle of the un-offset triangular head 112*e*. The angle $\theta'$ of the offset triangular head 112*h* may be held at as small as about 25 degrees, so that the two top end stops 107,108 are brought closer toward each other across the offset triangular head 112*h* when the slider 106 has moved up to its uppermost position effecting full closure of the slide fastener 100. When the tapes 104,105 are sewn at their upper ends to a garment or the like, the beaded edges 104' and 105' flex inwardly at considerably reduced angles $\alpha$ and $\beta$ with respect to the longitudinal axis of the top stops 107 and 108, respectively. This relationship reduces the resistance encountered upon starting movement of the slider 106.

Figure 6:
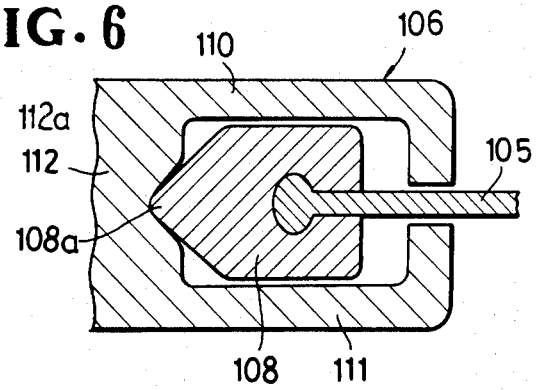
FIG. 6 is a cross-sectional view similar to FIG. 4 but illustrating a modified form of the invention.

FIG. 6 illustrates a modification wherein the recess 112*a*,(112*b*) in the diamond 112 has a cross-sectionally triangular shape and the top end stop 107,(108) has a complementarily pointed protuberance 108*a'* received in the recess 112*a*, (112*b*).

Figure 7:
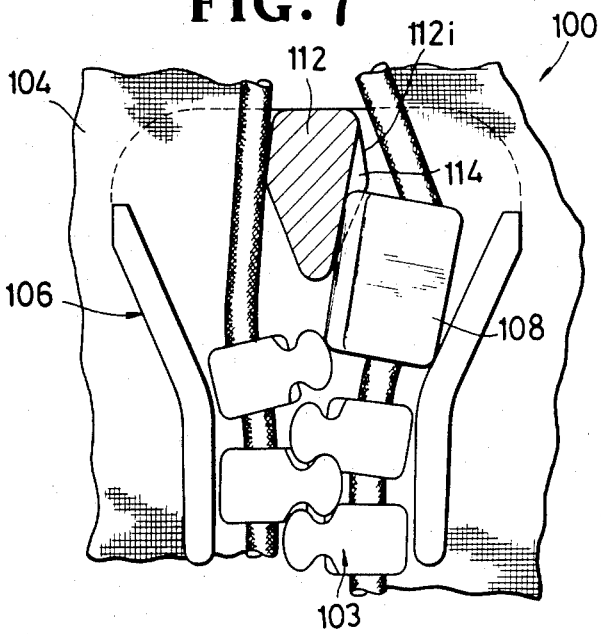
FIG. 7 is a plan view similar to FIG. 1 but illustrating another modification of the fastener according to the invention.

FIG. 7 shows another modification characterized by the provision of a recess 114 only at one side of the diamond 112.

Although various modifications and changes may be made by those versed in the art, it should be understood that I wish to embody within the scope of the patent warranted hereon, all such embodiments as reasonably and properly come within the scope of my contribution to the art.

What is claimed is:

1. A slide fastener assembly, comprising:

(a) a pair of stringers having oppositely disposed rows of fastener elements secured to respective support tapes;

(b) a slider having (1) an upper and a lower shield defining a space receptive of said fastener elements therebetween, and (2) a diamond portion connecting said shields, and defining therewith a Y-shaped guide channel, said diamond portion having opposite sidewalls between said shields and converging toward the rear end of said slider at a first angle, for engaging only said fastener elements and an elongated longitudinal recess in at least one of said sidewalls to be spanned by the fastener elements, said recess and the other of said sidewalls defining therebetween a second angle smaller than said first angle; and (c) at least one top end stop secured to one of said support tapes adjacent to the endmost fastener element thereof, said top end stop having an elongated central protruberance facing away from said one support tape and slidingly engageable with said diamond only in said elongated longitudinal recess.

2. A slide fastener assembly according to claim 1, said one sidewall comprising a pair of upper and lower guide surfaces for the fastener elements spaced by said recess.

3. A slide fastener assembly according to claim 1, including a pair of said top stops, and said diamond portion having in opposite ones of said opposite sidewalls thereof a symmetric pair of said elongated recesses receptive of and guidingly engageable with the respective protruberances of said top end stops, said elongated recesses extending convergently toward the rear end of said slider at a third angle which is smaller than said first angle.

4. A slide fastener assembly according to claim 3, each of said sidewalls having a pair of upper and lower guide surfaces spaced by one of said recesses.

5. A slide fastener assembly according to claim 3, said opposite saidewalls converging toward the rear end of said slider to form an un-offset triangular head having said first angle, said elongated recesses defining an offset triangular head having said thrid angle.

6. A slide fastener assembly according to claim 3, said third angle being in the neighborhood of 25 degrees.

* * * * *